United States Patent [19]

Terzian

[11] Patent Number: 4,720,823

[45] Date of Patent: Jan. 19, 1988

[54] PUSH-PULL, STEM-CONTROLLED DIGITAL TIME DISPLAYS

[75] Inventor: Berj A. Terzian, Briarcliff, N.Y.

[73] Assignee: Equitime Inc., Briarcliff Manor, N.Y.

[21] Appl. No.: 939,615

[22] Filed: Dec. 9, 1986

[51] Int. Cl.[4] ..... G04B 27/02

[52] U.S. Cl. ..... 368/190; 368/187; 368/70; 368/308

[58] Field of Search ..... 368/308, 190, 155, 184–187, 368/69–70, 319–321

[56] References Cited

U.S. PATENT DOCUMENTS

| | | | |
|---|---|---|---|
| 4,209,976 | 7/1980 | Flumm | 58/85 |
| 4,358,837 | 11/1982 | Yamazaki et al. | 368/69 |
| 4,367,958 | 1/1983 | Kawahara et al. | 368/188 |
| 4,444,511 | 4/1984 | Ogihara et al. | 368/69 |
| 4,509,867 | 4/1985 | Cleusix et al. | 368/321 |
| 4,600,316 | 7/1986 | Besson | 368/190 |

*Primary Examiner*—Bernard Roskoski
*Attorney, Agent, or Firm*—Lucas & Just

[57] ABSTRACT

A single push-pull stem control is provided for setting and operating digital time displays. The stem may be pushed into a first operative position, relative to a case housing the display and exposing it to view, in which it completes a circuit to the elements of the operating parts which generate normal timekeeping indicia in the display. Upon being pulled out of the case to a second operative position, the circuit to the normal timekeeping elements is discontinued and a circuit is established to elements of the operating parts which generate time setting indicia in the display. The stem may be turned in clockwise and counterclockwise directions while in the second position to perform setting and selecting functions, and also while in the first position to perform other desired functions.

22 Claims, 5 Drawing Figures

PUSH-PULL, STEM-CONTROLLED DIGITAL TIME DISPLAYS

BACKGROUND OF THE INVENTION

1. Field of the Invention

This invention relates to digital time displays that are useful for general purpose timekeeping, i.e., the timekeeping needs and practices of ordinary individuals carrying out their usual day-to-day activities.

2. Description of the Prior Art

Digital time displays have been available to consumers since the early 1970s, initially in the form of wrist watches, and then in a wider variety of products and implementations, for example, clocks, clock-radios, motor vehicle dashboard and boat cockpit clocks, audio and video recorders, other household articles and applicances, and many others. Typically these products have displayed the numerical value of each current hour, followed by a colon and values of incrementing minutes from zero to fifty nine during each hour, sometimes with similarly incrementing seconds during each minute. To this inventor's knowledge, all such products, with one exception, have incorporated operating buttons or bars that require manipulation in prescribed sequences in order to set and control the time displays. The overwhelming majority of consumers has considered such controls to be tedious, inconvenient, complicated and, in some extreme cases, beyond understanding.

The one exception has been in some motor vehicle digital clocks that have been operated by a stem control. For example, some Japanese-manufactured vehicles have dashboard digital clocks that are set by pushing on a stem to reset seconds to zero, turning the stem clockwise to advance minutes to a desired value, and turning the stem counterclockwise to advance hours to a desired value. Since seconds are not displayed by these clocks, the zeroing of such values is indicated by the displayed minutes resetting to double zero, which compels the operator to perform two separate resettings, first seconds and then minutes, an inconvenience and annoyance when there is only a need to reset seconds. Moreover, such a stem control does not distinguish different kinds of setting or operating functions by how it is used, since rotation of it in either direction causes the same type of effect, advancement of numerical values in the display.

More recently, other types of digital time displays have been described, for example, in U.S. Pat. Nos. 4,264,966; 4,271,497; 4,483,628 and copending application Ser. No. 734,979, now U.S. Pat. No. 4,627,737 the disclosures of which are incorporated herein by reference. Typically, these teach the display of hour digits at the center of a display field, minutes after a current hour to the right of such hours, minutes before a next hour to the left of such hours and, optionally, seconds below the hour digits, cycling either between zero and thirty during all minutes, or from zero to fifty nine and fifty nine to zero during elapsed and remaining minutes, respectively.

Prototype wrist watches have been manufactured incorporating the specific time display system disclosed in Ser. No. 734,979. In these prototypes, at least four separate buttons are used for setting and control purposes. One button is recessed in the case and operated exclusively to switch the time display between the setting mode, indicated by flashing seconds, and the normal time display mode, indicated by steady seconds. Another switches the day/date display to the current month in the normal time display, and selects a function for setting in the setting mode. Another is unused during the normal time display, and advances a selected function to accomplish setting in the setting mode. The fourth button lights the display for viewing in the dark in the normal time display mode and is unused in the setting mode.

Some models of these prototypes have a fifth button, also recessed, that is operated exclusively for switching the time display between an alarm setting mode and the normal time display. In this instance, the second and third buttons described above are also operated in the alarm setting mode to select and set a time for sounding an audible alarm. The same buttons are operated in the normal time display mode, in combination and singly, to activate and turn off the alarm at the selected alarm time.

Despite the availability of explicit operating and setting instructions, some users of these prototypes have complained about the difficulty and complexity of correctly carrying out the described button manipulations. As a matter of fact, this inventor believes that since their advent, all digital timepieces have been criticized more frequently because of the difficulty of setting and operating them than for any other reason, which has posed a major problem to their utility and salability. This is perhaps epitomized by one reader's letter to the editors of a news magazine, June 16, 1986 edition, which expressed the "joy" of using analog watches because they can be reset without having to carry the printed instructions in one's wallet.

SUMMARY OF THE INVENTION

The present invention provides push-pull, stem-controlled digital time displays which minimize or avoid the problems discussed above. In the displays of this invention, a stem is provided that may be pushed inwardly, relative to a case that houses the digital display and exposes it to view, into a first position that contacts a first circuit terminal in order to place it in a closed circuit condition. As a result, a power source is connected by a first circuit including the first circuit terminal to elements of the operating parts that generate present time indicia in the display. Simultaneously, power is discontinued to the operating parts that generate time setting indicia in the display.

The stem may also be pulled outwardly, relative to the case, into a second position that switches the first circuit terminal into an open circuit condition. As a result, the power supply to the operating parts that generate present time indicia is discontinued and power is connected through a second circuit to the operating parts that generate time setting indicia in the display. Therefore, the viewer may readily control the display by pushing the stem in for normal time operation and pulling it out for setting purposes. This fundamental distinction in the basic functions of the respective two stem positions can be easily learned and remembered without the need for carrying instructions to perform it.

The stem is also spring biased to enable turning it in clockwise or counterclockwise directions, at least in the second pulled-out setting position, and preferably in both that and the first pushed-in normal time display position. In the second position counterclockwise turning preferably brings one of a pair of terminals on the stem into contact with a third circuit terminal for connecting the power source through a third circuit including such terminal to elements of the operating parts that select a time function. Conversely, clockwise turning of the stem preferably brings the other of the terminals on the stem into contact with a fourth circuit terminal for connecting the power source through a fourth circuit including such terminal to elements of the operating parts that advance a selected time function to enable setting it.

Thus, the viewer is again provided with a fundamental distinction in the turning functions of the pulled-out stem that can be easily learned and remembered without separate instructions, i.e., turn counterclockwise to select and clockwise to set. A simple push of the stem thereafter restores a present time display conforming to the time setting that has been performed with the pulled-out stem.

These manipulations of the stem are somewhat like those that have been incorporated historically in analog timepieces for setting and control purposes. Therefore, the use of push-pull, stem-controlled digital time displays in accordance with this invention should substantially narrow the gap between the learning time and effort required to operate such displays, in comparison to the previous, much-criticized conventional digital displays.

Other features and advantages of the invention will be understood from the subsequent detailed description, taken in connection with the drawings.

BRIEF DESCRIPTION OF THE DRAWINGS

Referring now to FIG. 1, there is illustrated three basic components of, for example, a digital wrist watch incorporating the timekeeping display system disclosed in Ser. No. 734,979. First, there is a fragment of a disc-shaped printed circuit board 10, which is preferably molded of a resilient plastic insulating material. Secondly, there is a metal push-pull stem 12. And lastly there is a fragment of the side wall 14 of a circular case for housing the operating parts of the digital display and exposing it to view.

Figure 1:
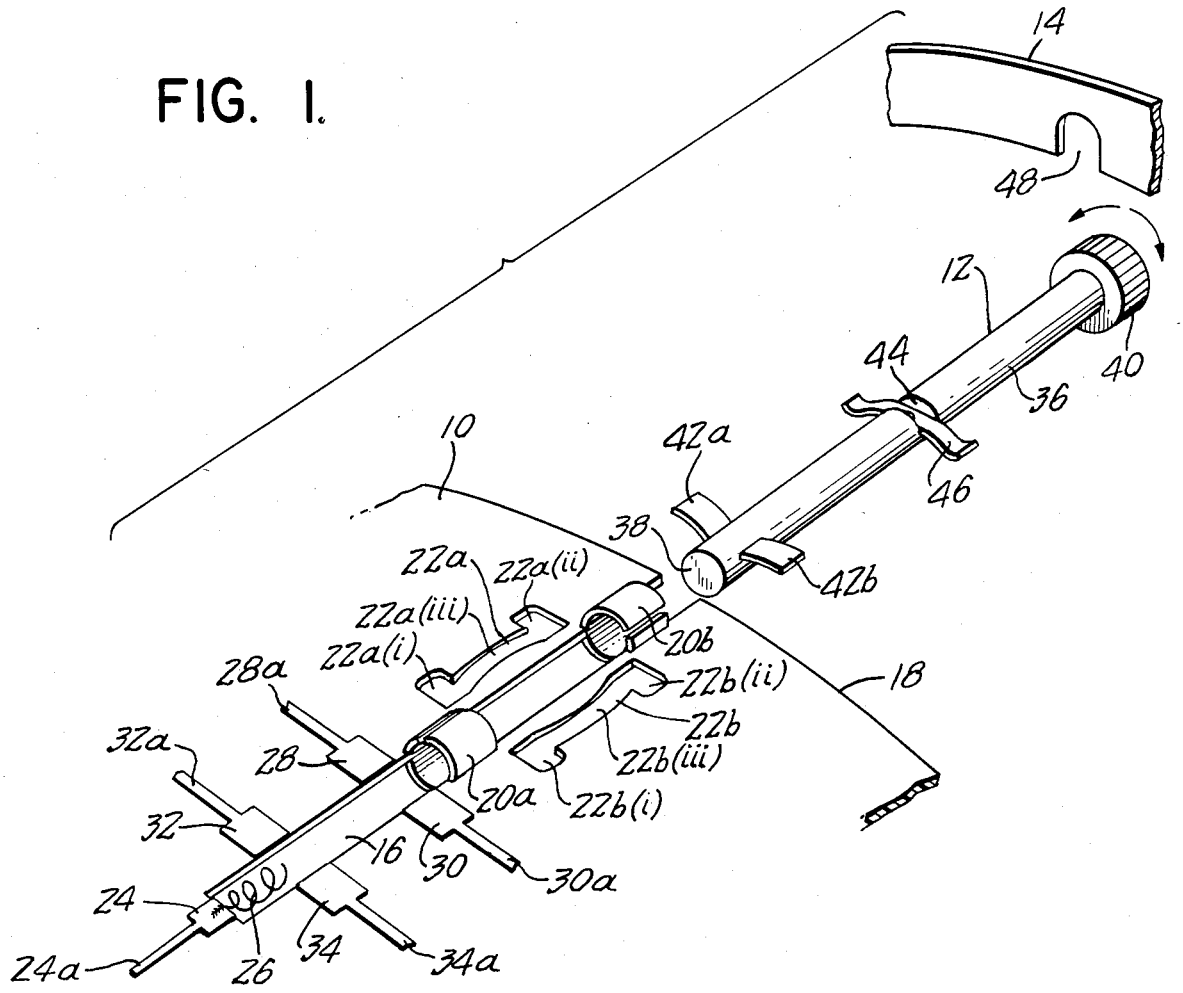
FIG. 1 is an exploded perspective view on a magnified scale of exemplary essential parts required to construct and use an embodiment of this invention.

Circuit board 10 is provided with an open slot 16 extending inwardly from its outer circular edge 18. Slot 16 is bridged by two tubular split bearings 20*a* and 20*b*, which are located at spaced radial positions relative to each other. As illustrated, the splits in the tops of these bearings are angularly offset so that they are out of alignment with each other relative to the radial axis of the slot 16.

Between the bearings 20*a* and 20*b*, and flanking the edges of slot 16 in that location, are two depressions 22*a* and 22*b* in the upper surface of circuit board 10. Depressions 22*a* and 22*b* are shaped somewhat like halfdumbbells, each with opposite ends, 22*a*(i) and (ii), and 22*b*(i) and (ii), flared outwardly away from slot 16, and with a narrower middle section, 22*a*(iii) and 22*b*(iii), connecting such ends. Also, the middle sections 22*a*(iii) and 22*b*(iii) are each provided with oppositely inclined floors which rise from the flared ends of each depression to a peak at the center of the connecting middle section. Therefore, as the distance from one to the other flared end of each depression is traversed along its floor, there is first an incline until the peak is reached at the center of the middle section and then a decline from there to the floor of the opposite flared end. These depressions serve as tracks and guides for the linear and turning movements of the push-pull stem 12, as will be more fully explained below.

At the base of slot 16, circuit board 10 is provided with a first circuit terminal 24 which is connected to and extended by coil spring 26 into the open space of the slot. This terminal is connected by integral lead 24*a* to those elements of the operating parts of the digital display which generate present time indicia in the display. Between terminal 24 and bearing 20*a*, and flanking the edges of slot 16 in that location, are four more circuit terminals 28, 30, 32 and 34, each with associated integral leads 28*a*, 30*a*, 32*a* and 34*a*. For clarity of description in this specification and the appended claims, these will be designated as the third, fourth, fifth and sixth circuit terminals, respectively, with omission of reference to a second circuit terminal for reasons which will be explained below.

Terminal 28 and lead 28*a* are connected to those elements of the operating parts which advance the values of a selected time function in order to set that function. Terminal 30 and lead 30*a* are connected to those elements of the operating parts which select a specific time function for setting, for example, in the sequence illustrated in FIG. 5. Terminal 32 and lead 32*a* are connected to those elements of the operating parts which light the display for viewing in the dark. Terminal 34 and lead 34*a* are connected to those elements of the operating parts which, in this specific embodiment, switch a day/date value in the display to the value of a current month.

Referring now to push-pull stem 12, it comprises an elongated rod-like section 36, having an outside diameter that fits snugly within the inside diameter of the split bearings 20*a* and 20*b*. The lower end 38 of section 36 is designed to alternate between contact with and separation from the coil spring 26. The opposite end is provided with a knurled operating knob 40.

Near its lower end 38, stem 36 is formed with a pair of integral terminals 42*a* and 42*b*, shaped like tabs which extend outwardly in opposite directions from the stem. Between terminals 42*a* and 42*b* and knob 40, the top of stem 36 is notched to form a recess 44 with a flat floor upon which is mounted a leaf spring 46, secured in place with a screw or rivet 48 (FIGS. 2 and 3). Leaf spring 46 extends transversely of stem 36 and is shaped to curve downwardly as it extends outwardly from recess 46 in opposite transverse directions. The opposite tips of the spring 46 are turned upwardly to provide gently curved undersides that cooperatively engage in sled-like manner with depressions 22*a* and 22*b*, as will be more fully explained below. The foregoing description of the parts illustrated in FIG. 1 is completed by reference to the opening 48 in the sidewall of case 14, which opening is of an inside diameter that snugly fits around the outside diameter of stem 12 when these parts are assembled together.

Figure 2:
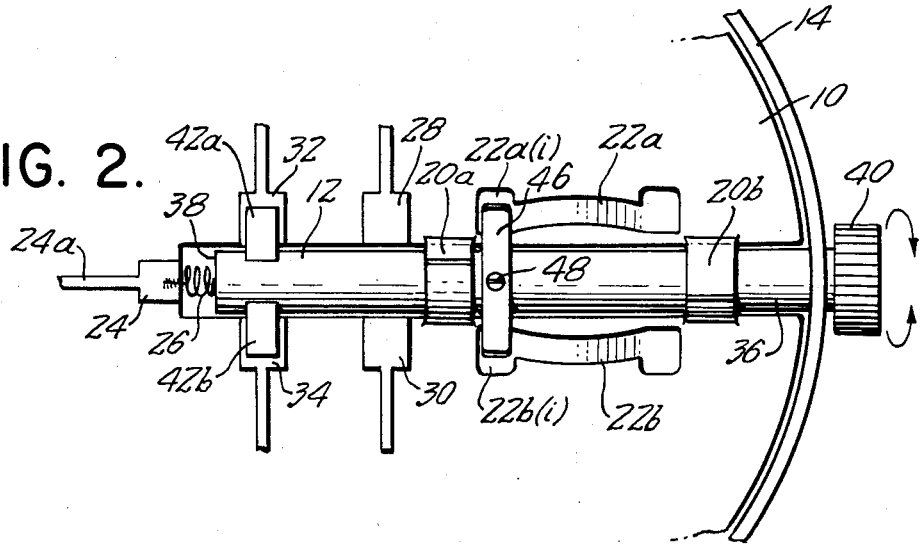
FIG. 2 is a top plan view of the assembled parts of FIG. 1, including a push-pull stem in a first operative position.
Figure 3:
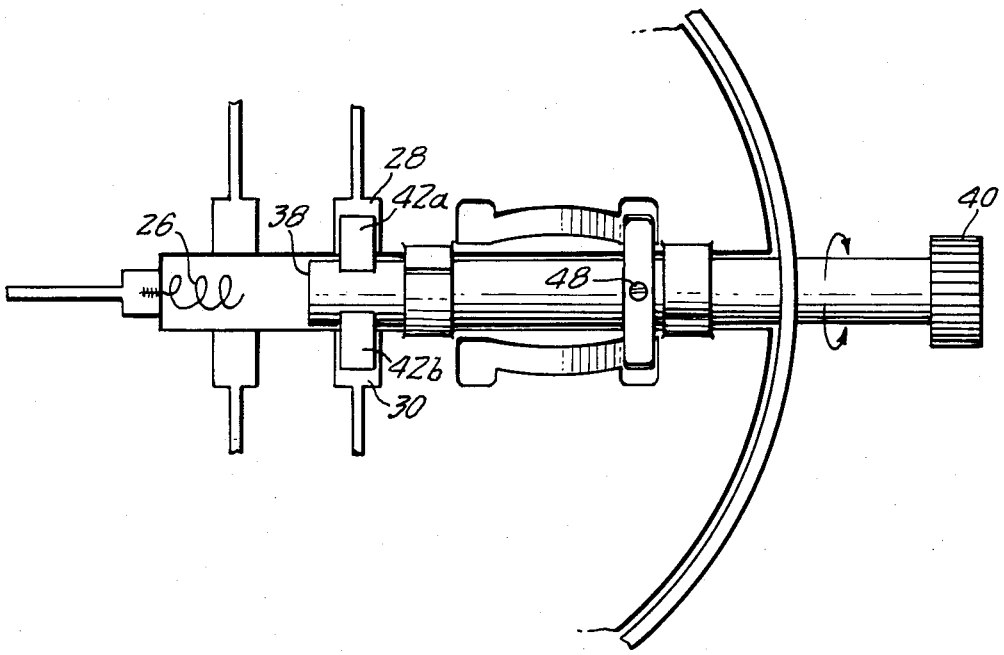
FIG. 3 is similar to FIG. 2 showing the push-pull stem in a second operative position.

FIG. 2 shows the parts illustrated in FIG. 1 assembled together. This assembly is formed by placing the stem 12 initially over the split bearing 20*a*, prying apart the split ends of this bearing to permit the stem to enter the bearing's interior space, and doing the same with the second bearing 20*b*. The split ends of the bearings thereafter will resiliently return to their original shape to overlie and maintain the stem 12 within their tubular spaces.

After the stem 12 is assembled within bearings 20*a* and 20*b* as described above, it is pushed inwardly, relative to the case 14, into the first operative position illustrated in FIG. 2. In this position, the end 38 is in contact with coil spring 26 and thus connected to the first circuit terminal 24 and associated lead 24*a*. Leaf spring 46 is dimensioned to be resting with slight pressure upon the floors of the flared ends 22*a*(i) and 22*b*(i) of the depressions 22*a* and 22*b*, to maintain stem 12 in a neutral unturned angular position in which the tab terminals 42*a* and 42*b* overlie but are out of contact with the fifth and sixth circuit terminals 32 and 34. The action of spring 46 is similar to that of boat outriggers, in that the upturned outer ends of the spring, while in engagement with the floors of the flared ends 22*a*(i) and 22*b*(i), keep stem 12 in a balanced neutral position in which it is in contact solely with coil spring 26.

This construction also permits stem 12 to be turned in clockwise and counterclockwise directions to bring its tab terminals 42*a* and 42*b* into intermittent or steady contact with the fifth and sixth circuit terminals 32 and 34, respectively. In this regard, the flared ends 22*a*(i) and 22*b*(i) of depressions 22*a* and 22*b* are purposely extended transversely beyond the tips of spring 46 in the unturned neutral position, in order to accommodate transverse flexing and extension of the spring as it increases its transverse length in reaction to the clockwise or counterclockwise turns of stem 12, applied by the viewer to the operating knob 40. The spacings between the tab terminals 42*a* and 42*b* and the circuit terminals 32 and 34 in the neutral unturned position are dimensioned to require, preferably, up to about one quarter of a full turn to bring each pair of the respective terminals into contact with each other, facilitating these manipulations of stem 12 by the viewer. Upon release of such turns in either the clockwise or counterclockwise direction, spring 46 recovers its unflexed configuration and automatically returns stem 12 to its unturned neutral position.

Accordingly, in the first operative position of stem 12 illustrated in FIG. 2, there is continuous contact between stem 12 and coil spring 26 in the neutral unturned position, and this continuity is maintained whenever the stem is turned clockwise or counterclockwise to cause other display functions to occur by contact of tab terminals 42*a* and 42*b* with the circuit terminals 32 and 34, respectively.

FIG. 3 shows stem 12 in a second operative position, attained by pulling the knob 40 outwardly from the case 14, as indicated by the horizontal arrow. During this movement, the upturned ends of spring 46, as they leave flared ends 22*a*(i) and 22*b*(i), ride with increasing resistance on the inclined floors of depressions 22*a* and 22*b* up until the peaks at the midpoints of the middle sections (22*a*(iii) and 22*b*(iii)), and then gradually relax as they travel down the declined floors into the opposite flared ends 22*a*(ii) and 22*b*(ii). In this way, the operator is given tactile confirmation of having moved stem 12 from its first to second operative position, and vice versa. Furthermore, the upwardly extending prongs of split bearing 20*b* are positioned in nearly exact transverse alignment with the radial limits of flared ends 22*a*(ii) and 22*b*(ii) to act as stops for spring 46, beyond which stem 12 may not be further pulled away from case 14. The same arrangement is used at the opposite flared ends 22*a*(i) and 22*b*(i) to provide stops that prevent further inward pushing of stem 12 into case 14. Therefore, the operator is given tactile confirmation by these stop actions of having correctly shifted stem 12 into either of its operative positions.

In the second operative position illustrated in FIG. 3, the end 38 of stem 12 has moved out of contact with coil spring 26, and the tab terminals 42*a* and 42*b* now overlie but are out of contact with the third and fourth circuit terminals 28 and 30. Spring 46 cooperates with the flared ends 22*g*(ii) and 22*b*(ii) to perform the same previously described outrigger-like balancing action to maintain stem 12 in its neutral unturned angular position, the only difference being the new radial alignment of the tab terminals 42*a* and 42*b* with the third and fourth circuit terminals 28 and 30. Likewise, in its second operative position, the stem I2 may be turned by manipulation of knob 40 to the same degree in clockwise and counterclockwise directions and, upon release, with automatic return to the neutral unturned position, as previously described, this time to bring tab terminals 42*a* and 42*b* into intermittent or continuous contact with circuit terminals 28 and 30, respectively.

Figure 4:
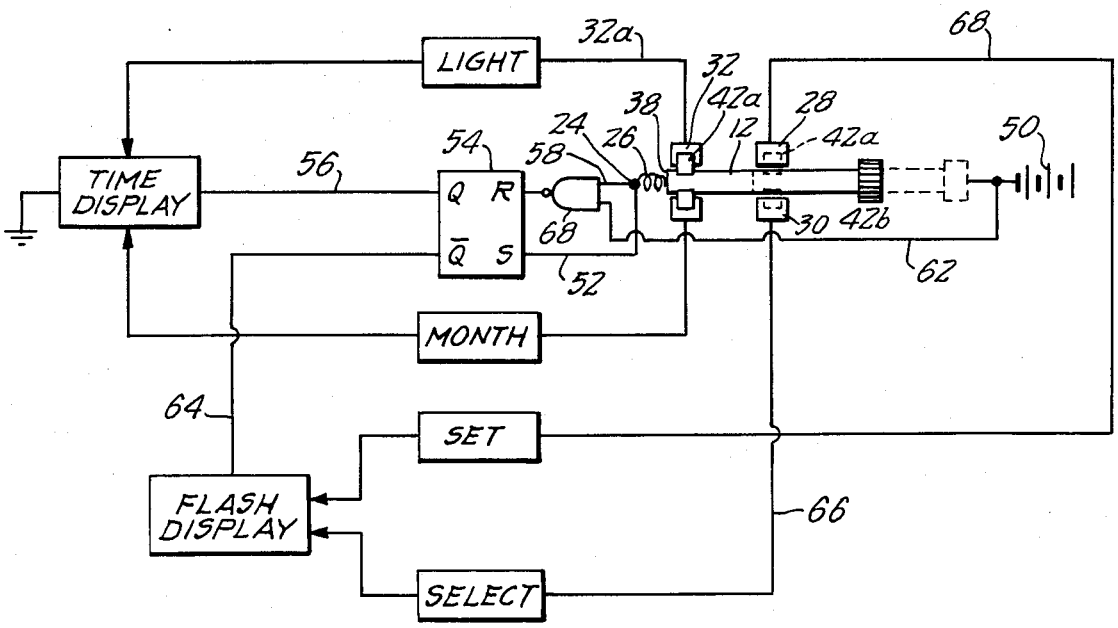
FIG. 4 is a logic diagram of an electronic circuit incorporating the push-pull stem of the previous figures.

Referring now to FIG. 4, there is illustrated the incorporation of stem 12 in the logic circuit of an electronic digital timepiece corresponding to the previously mentioned prototypes of Ser. No. 734,979, with the solid line representation of the stem corresponding to the first operative position illustrated in FIG. 2, and the phantom line representation corresponding to the second operative position of FIG. 3.

Considering the first operative position, stem 12 connects battery 50 through end 38, coil spring 26, terminal 24 and branch lead 52 to the set terminal (S) of an RS flop 54, which provides output from the Q terminal through lead 56 to those elements of the operating parts which generate present time indicia in the digital display, signified by the box labelled "TIME DISPLAY". Another branch lead 58 connects terminal 24 to NAND gate 60, and a separate lead 62 also applies the output of battery 50 as a second input to gate 60. With both of its inputs high while stem 12 is in its first (solid line) position, NAND gate does not conduct and provides no output over the line connecting it to the R terminal of flop 54. Therefore, flop 54 remains in its set position to provide continuous power to the normal timekeeping elements of the display's operating parts. Also, stem 12 may be turned clockwise to complete a circuit from battery 50, through stem 12, tab terminal 42*a*, fifth circuit terminal 32 and lead 32*a* to those elements of the operating parts, signified by the box labelled "LIGHT", which light the time display for viewing in the dark. Turning of the stem 12 in the counterclockwise direction will complete a circuit from battery 50, through the stem, tab terminal 42*b*, circuit terminal 34 and lead 34*a* to those elements of the operating parts, signified by the box labelled "MONTH", which convert a continuous display of the day/date to the month in the prototype timepieces of Ser. No. 734,979.

It will be understood that the above described lighting and day/date-to-month-switching functions will be maintained for as long as the stem 12 is turned into the positions that establish the described circuits for such functions, and that the same will cease upon release of the stem and its automatic return to its neutral position, when such circuits are discontinued.

Referring now to the pulled-out second operative position (phantom lines) of stem 12 in FIG. 4, upon separation of end 38 from coil spring 26, the supply of battery output to branch lead 58 ceases and this lead correspondingly provides no input to NAND gate 60. With one of its inputs thus at reference level and the other input from lead 62 high, gate 60 conducts to provide output to the R terminal of flop 54, resetting the flop to discontinue output at the Q terminal and provide output at the $\overline{Q}$ terminal. This resetting of flop 54 completes a circuit through lead 64 to those elements of the operating parts which generate time setting indicia, which initially are flashing seconds in the prototype timepieces of Ser. No. 734,979, signified by the box labelled "FLASH DISPLAY". Simultaneously, supply of power to the normal timekeeping elements is discontinued from the Q terminal and lead 56. If stem 12 is thereafter pushed back into its first position, contact will be re-established between its end 38 and coil spring 26 to restore the circuit to its previous condition described above, with NAND gate 60 non-conducting and the flop 54 consequently set to provide output at the Q terminal for normal timekeeping (lead 56) and to discontinue output to the flashing setting display (lead 64).

While in the setting position, counterclockwise turning of stem 12 will bring tab terminal **42*b* into contact with fourth circuit terminal 30, to complete a circuit from battery 50 through the stem, these terminals and lead 66 to those elements of the operating parts, signified by the box labelled "SELECT", which select a specific time function for setting. Such selection is indicated by flashing of the selected function. Conversely, clockwise turning of stem 12 will bring its tab terminal 42*a* into contact with third circuit terminal 28 to complete a circuit from battery 50 through the stem, these terminals and lead 68** to those elements of the operating parts, signified by the box labelled "SET", which set the selected time function by advancing it stepwise through a loop containing all of its possible values.

Figure 5:
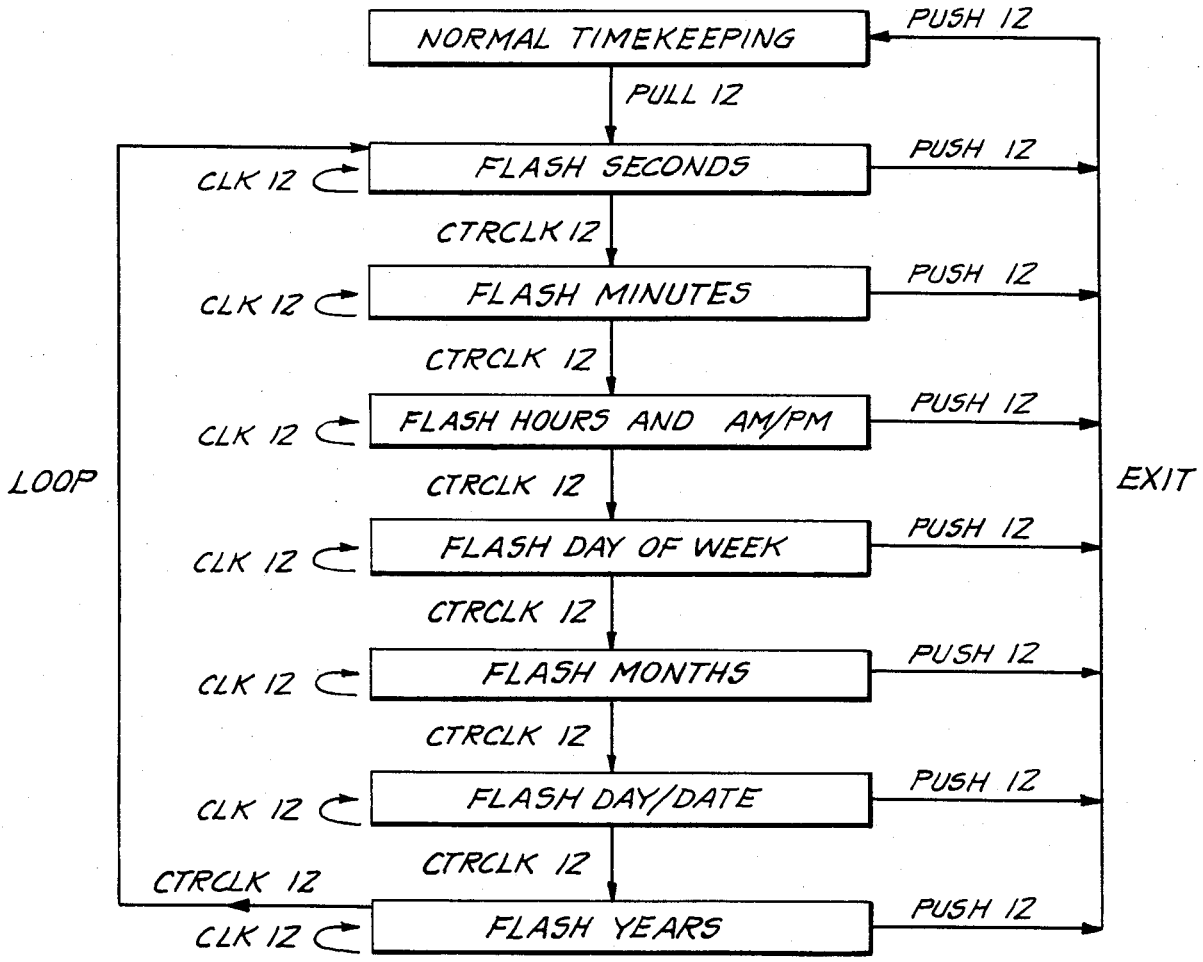
FIG. 5 is a logic diagram of normal timekeeping, as well as setting sequences and functions, that may be readily controlled with the push-pull stem of the previous figures.

Referring now to FIG. 5, there is illustrated a summary of the controls that are accomplished by operation of stem 12 in the manner described above, with the circuits of the prototype timepieces of Ser. No. 734,979. A pulling out of the stem switches the time display into the setting mode signified by flashing seconds. Seconds may be reset to zero by clockwise turning of stem 12, signified by "clk 12" adjacent the looped arrow at the left side of the "FLASH SECONDS" box in FIG. 5. Thereafter, counterclockwise turning of stem 12 will select each subsequent time function for setting in the sequence shown in FIG. 5, such operation being signified by "ctrclk 12" between each successive function. Each such function may be individually set, after selection, by clockwise turning of stem 12, as indicated by "clk 12" adjacent the box representing each function. The setting sequence will repeat itself, as indicated by the feedback arrow labelled "LOOP". At any time, the display may be returned to normal timekeeping by pushing stem 12 back into its first position, as is signified by the "push 12" labels adjacent each time function and the feedback arrow labelled "EXIT". The above operations may be carried out in single steps by corresponding intermittent contact of the respective terminals with each other, or with continuous stepwise scrolling by maintaining the terminals in steady contact.

Thus, by simple push-pull and turning movements of stem 12, four buttons of the previous prototypes may be replaced by a single operating part, to render setting and control of the digital time display substantially easier to learn and remember.

The principles discussed above may be extended for further simplification in more complicated embodiments. For example, reference has been made to the fact that some of the prototype timepieces of Ser. No. 734,979 incorporate a fifth button to control an alarm setting function. This can be eliminated with the single stem 12 of this invention by utilizing the sixth circuit terminal 34 for the alarm setting and control circuits. Specifically, counterclockwise rotation of stem 12 in its first pushed-in position may be used to complete a circuit from battery 50 through tab terminal **42*b* and terminal 34 to elements of the operating parts which enter the display into the alarm setting mode. Thereafter, stem 12 may be pulled out to its second operative position and the hour and minutes of the desired alarm time may be selected and set by using the same counterclockwise and clockwise turns, as previous1y described. Return of the stem 12 to its pushed in position and successive counterclockwise turns of the stem, for corresponding successive contacts between tab terminal 42*b* and circuit terminal 34, may then be used to activate and deactivate the sounding of the alarm at the selected alarm time. In this way, the single push-pull stem 12** may be used to replace all five operating buttons of the previous alarm prototypes.

In the above illustrative embodiments, stem 12 makes contact with coil spring 26 in its first operative position to effect normal timekeeping in the display. On the other hand, the display goes into the setting mode when this contact is discontinued by pulling the stem out into its second operative position, without engagement of the stem with another contact. It is for this reason that the setting and select circuit terminals 28 and 30 have been designated "third" and "fourth" in the above description, without reference to a second circuit terminal which is not actually used in rendering the stem operative in its second pulled-out position. It will be understood that these designations have been selected solely for clarity of description in this specification and appended claims, and are not otherwise significant with respect to the functioning of the invention.

The invention has now been described in terms of its operative principles and illustrative embodiments. It provides substantial simplification of the setting and control of digital time displays, which enables making digital timepieces of a wide variety much more readily acceptable and useful to consumers. It will be understood that the invention may be practiced with any form of digital time display, both of the conventional type and those described in the previously cited patents and application.

It will also be understood that this invention is not limited to the illustrative embodiments but encompasses the subject matter delineated by the following claims and all equivalents thereof.

The following is claimed:

1. Push-pull, stem-controlled digital time displays which comprise:

(a) case means for housing the operating parts of a digital time display and for exposing the display to view;

(b) first circuit means including a first circuit terminal for connecting a power source to elements of the operating parts which generate present time indicia in the display when the first circuit terminal is in a closed circuit condition, the supply of power to such elements being discontinued when the first circuit terminal is in an open circuit condition;

(c) a second circuit means for connecting the power source to elements of the operating parts which generate time setting indicia in the display when the first circuit terminal is in an open circuit condition, the supply of power to such elements being discontinued when the first circuit terminal is in a closed circuit condition;

(d) stem means which, relative to the case means, may be pushed inwardly into a first position that places the first circuit terminal in a closed circuit condition and which may be pulled outwardly into a second position that switches the first circuit terminal into an open circuit condition, the stem means also being rotatably mounted to enable it to be turned in clockwise and counterclockwise directions at least while in the second position;

(e) means on the stem means for activating elements of the time setting operating parts which select a time function for setting when the stem means is turned in one of the clockwise and counterclockwise directions and which set the selected time function when the stem means is turned in the other of such directions, whereby:

(i) switching from normal timekeeping to time setting is always performed by pulling the stem means out into its second position;

(ii) selection of a time function for setting is always performed by turning the stem means in one of the clockwise and counterclockwise directions while in its second position;

(iii) setting of a selected time function is always performed by turning the stem means in the other of such clockwise and counterclockwise directions while in its second position; and (iv) present time indicia for normal timekeeping are always restored by pushing the stem means into its first position.

2. Displays in accordance with claim 1 in which the power source is a battery and the stem means is electrically connected to the battery and makes physical contact with the first circuit terminal when pushed into the first position, thereby directly placing the first circuit terminal in a closed circuit condition and connecting the battery to the first circuit means.

3. Displays in accordance with claim 1 further comprising third and fourth circuit means including third and fourth circuit terminals for connecting the power source to elements of the operating parts which set a selected time function and which select a time function for setting, respectively, when the stem means is in its second position, a pair of terminals provided on the stem means, one of which pair may be brought into contact with the third circuit terminal by turning the stem means in one direction, and the other of which pair may be brought into contact with the fourth circuit terminal by turning the stem means in the opposite direction when the stem means is in its second position, whereby the viewer may set the display by pulling the stem means into its second position and turning it in the one and other directions to select and advance a desired time function, and thereafter may restore present time indicia in the display by pushing the stem means into its first position.

4. Displays in accordance with claim 3 in which the pair of terminals comprise tabs extending outwardly in opposite directions from the stem means and being normally located in positions adjacent to and spaced from the third and fourth circuit terminals, such spaces being selected to require a predetermined degree of turning of the stem means in the one and other directions to bring the tabs into contact with the third and fourth circuit terminals, respectively.

5. Displays in accordance with claim 4 in which one of the tabs is brought into contact with the fourth circuit terminal by turning the stem means counterclockwise to select a time function for setting, and the other of the tabs is brought into contact with the third circuit terminal by turning the stem means clockwise to set the selected time function.

6. Displays in accordance with claim 4 in which the predetermined degree of turning in the one and other directions each does not exceed approximately one quarter of a complete revolution of the stem means.

7. Displays in accordance with claim 3 in which the stem means is spring biased to remain normally in an unturned neutral position in which its pair of terminals are out of contact with the third and fourth circuit terminals, the spring bias being operable to return the stem means automatically to its neutral position upon release after being turned into either position that contacts its terminals with the third or fourth circuit terminals, respectively.

8. Displays in accordance with claim 3 which further comprise fifth circuit means including a fifth circuit terminal for connecting the power source to elements of the operating parts which light the display for viewing in the dark, one of the pair of terminals on the stem means being located adjacent to and spaced from the fifth circuit terminal and capable of being brought into contact therewith by turning the stem means in clockwise or counterclockwise direction when the stem means is in its first position, whereby present time indicia may be viewed in the dark by turning the stem means while in its first position until its one terminal contacts the fifth circuit terminal.

9. Displays in accordance with claim 8 in which the stem means is spring biased to remain normally in an unturned neutral position with its one terminal out of contact with the fifth circuit terminal, the spring bias being operable to return the stem means automatically to its neutral position upon release after being turned into the position that contacts its one terminal with the fifth circuit terminal.

10. Displays in accordance with claim 8 in which the stem means is turned in a clockwise direction to bring its one terminal into contact with the fifth circuit terminal.

11. Push-pull, stem-controlled digital time displays which comprise:

(a) case means adapted for housing the operating parts of a digital time display as a wrist watch that exposes the display to view;

(b) first circuit means including a first circuit terminal for connecting a battery included within the case means to elements of the operating parts which generate present time indicia in the display when the first circuit terminal is in a closed circuit condition, the supply of battery power to such elements being discontinued when the first circuit terminal is in an open circuit condition;

(c) second circuit means for connecting the battery to elements of the operating parts which generate time setting indicia when the first circuit terminal is in an open circuit condition, the supply of battery power to such elements being discontinued when the first circuit terminal is in a closed circuit condition;

(d) stem means which, relative to the case means, may be pushed inwardly into a first position that contacts the first circuit terminal to place it in a closed circuit condition and which may be pulled outwardly into a second position that discontinues such contact to switch the first circuit terminal into an open circuit condition;

(i) such stem means having a pair of terminals in the form of tabs projecting outwardly in opposite directions therefrom; and (ii) such stem means being turnable in clockwise and counterclockwise directions when in its second position;

(e) third and fourth circuit means including third and fourth circuit terminals for connecting the battery to elements of the operating parts which set a selected time function and which select a time function for setting, respectively, such connections being established by turning the stem means, while in its second position, in counterclockwise direction to bring one of its tab terminals into contact with the fourth circuit terminal and in clockwise direction to bring its other tab terminal into contact with the third circuit terminal; whereby the viewer control of the display is to:

(i) always show present time indicia by pushing the stem means into its first position;

(ii) always show time setting indicia by pulling the stem means into its second position;

(iii) always select and set time functions by turning the stem means in a counterclockwise and clockwise directions while in its second position to bring its tab terminals into contact with the fourth and third circuit terminals, respectively, and (iv) return to present time indicia by pushing the stem means back into its first position.

12. Displays in accordance with claim 11 in which the first circuit terminal includes a coil spring and the stem means is connected to the battery, one end of the stem means when in its first position pressing upon the coil spring to place the first circuit terminal in a closed position that connects the battery to the first circuit means, and such end separating from the coil spring when the stem means is pulled out to its second position.

13. Displays in accordance with claim 12 including electronic gating means which is enabled when the stem means is in its first position to route the battery power supply from the first circuit terminal to the elements of the operating parts that generate present time indicia, and which is disabled to discontinue such routing when the stem means is pulled out into its second position.

14. Displays in accordance with claim 11 in which the stem means is spring biased when in its second position to remain in an unturned neutral position that maintains its tab terminals out of contact with the third and fourth circuit terminals, the spring bias being operable to return the stem means automatically to its neutral position upon release after being turned into either position that contacts its tab terminals with the third or fourth circuit terminals, respectively.

15. Displays in accordance with claim 14 which includes a fifth circuit means including a fifth circuit terminal for connecting the battery power supply to elements of the operating parts that light the display for viewing in the dark, and in which the stem means is turnable in clockwise direction when in its first position to bring one of its tab terminals into contact with the fifth circuit terminal to establish such connection, the stem means being spring biased to return automatically to its neutral position wherein its one tab terminal is out of contact with the fifth circuit terminal upon release after being turned into the position that brings that one tab terminal into contact with the fifth circuit terminal.

16. Displays in accordance with claim 14 and 15 in which the third and fourth circuit terminals are located upon the surface of a support and in which the stem means is provided with a leaf spring extending transversely therefrom, the tips of the spring being in pressure contact with the surface of the support to maintain the tab terminals on the stem means out of contact with the third and fourth circuit terminals when the stem means is in its second position.

17. Displays in accordance with claim 16 in which the surface of the support is provided with recesses aligned parallel to the push-pull direction in which the stem means is moved between its first and second positions, the tips of the leaf spring sliding in pressure contact upon the floors of such recesses to maintain the stem means in its unturned neutral position as it moves between its first and second positions.

18. Displays in accordance with claim 17 in which the floors of each recess are inclined upwardly from each end thereof to the center so that the tips of the spring ride on the floors of the recesses with first increasing and then decreasing resistance as the stem means is moved from one to the other of its first and second positions, thereby providing tactile confirmation to one operating the stem means of having shifted it from the one to the other of such positions.

19. Displays in accordance with claim 17 in which the floors of the opposite ends of each recess are flared outwardly away from the stem means and the tips of the spring are in pressure contact with the floors of the flared ends when the stem means is in its first or second position, the flared ends enabling the spring tips to flex and extend laterally thereon in reaction to counterclockwise or clockwise turning of the stem means into either its first or second position and then to recover their original unflexed and unextended configurations upon release of the stem means, thereby automatically returning the stem means to its unturned neutral position.

20. Displays in accordance with claim 16 in which the stem means is provided with an upper notch having a flat floor, the leaf spring being mounted upon the flat floor.

21. Displays in accordance with claim 1 in which setting of each selected time function is carried out by stepwise forward advance of its displayed values in a self-repeating sequence comprising all of the function's possible values.

22. Displays in accordance with claim 11 in which setting of each selected time function is carried out by stepwise forward advance of its displayed values in a self-repeating sequence comprising all of the function's possible values.

* * * * *

UNITED STATES PATENT AND TRADEMARK OFFICE

CERTIFICATE OF CORRECTION

PATENT NO. : 4,720,823

DATED : January 19, 1988

INVENTOR(S) : Berj A. Terzian

It is certified that error appears in the above-identified patent and that said Letters Patent are hereby corrected as shown below:

Fig. 4, insert a lead line from reference numeral 42b to tab terminal 42b.

Column 11, line 34, change "viewer" to --viewer's--.

Column 12, line 16, change "and" to --or--.

Signed and Sealed this

Twentieth Day of September, 1988

*Attest:*

DONALD J. QUIGG

*Attesting Officer*

*Commissioner of Patents and Trademarks*